US009959810B2

(12) United States Patent
Kim

(10) Patent No.: US 9,959,810 B2
(45) Date of Patent: May 1, 2018

(54) ORGANIC LIGHT EMITTING DISPLAY AND DRIVING METHOD OF OPERATING THE SAME

(71) Applicant: Samsung Display Co., Ltd., Yongin (KR)

(72) Inventor: Hyun Sik Kim, Jeonju-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 417 days.

(21) Appl. No.: 14/619,915

(22) Filed: Feb. 11, 2015

(65) Prior Publication Data

US 2016/0086540 A1 Mar. 24, 2016

(30) Foreign Application Priority Data

Sep. 19, 2014 (KR) ..... 10-2014-0125131

(51) Int. Cl.
*G09G 3/30* (2006.01)
*G09G 3/3275* (2016.01)
*G09G 3/3233* (2016.01)

(52) U.S. Cl.
CPC ..... *G09G 3/3275* (2013.01); *G09G 3/3233* (2013.01); *G09G 2320/029* (2013.01);
(Continued)

(58) Field of Classification Search
CPC .. G09G 3/3233; G09G 3/3258; G09G 3/3266; G09G 3/3275; G09G 2320/0233;
(Continued)

(56) References Cited

U.S. PATENT DOCUMENTS

2007/0200608 A1* 8/2007 Fang ..... H03H 11/26 327/261
2008/0237479 A1* 10/2008 Iwakiri ..... G01T 1/2928 250/370.08

(Continued)

FOREIGN PATENT DOCUMENTS

KR 10-2007-0115494 6/2007
KR 10-0902245 6/2009

(Continued)

OTHER PUBLICATIONS

Hyun-Sik Kim, et al., "High-Linearity In-Pixel Thermal Sensor Using Low-Temperature Poly-Si Thin-Film Transistors", IEEE Sensors Journal, Sep. 19, 2014, vol. 15, Issue 2 (pp. 1-7).

*Primary Examiner* — Amr Awad
*Assistant Examiner* — Aaron Midkiff
(74) *Attorney, Agent, or Firm* — H.C. Park & Associates, PLC

(57) ABSTRACT

An organic light emitting display, including a first data line extending along a first direction, a second data line extending along the first direction and disposed parallel to the first data line, a first scan line extending along a second direction perpendicular to the first direction, a first pixel connected to the first data line and the first scan line, a second pixel connected to the second data line and the first scan line, a first constant current source connected to the first data line, a second constant current source connected to the second data line, and a temperature information generation unit comprising a first input port connected to the first data line and a second input port connected to the second data line.

10 Claims, 8 Drawing Sheets

(52) U.S. Cl.
CPC ..... *G09G 2320/0295* (2013.01); *G09G 2320/041* (2013.01)

(58) Field of Classification Search
CPC ..... G09G 2320/029; G09G 2320/0295; G09G 2320/041
USPC ..... 345/76–83, 211–214; 315/169.1–169.4
See application file for complete search history.

(56) References Cited

U.S. PATENT DOCUMENTS

| | | | | |
|---|---|---|---|---|
| 2009/0184901 | A1* | 7/2009 | Kwon | G09G 3/3233 345/77 |
| 2011/0007067 | A1* | 1/2011 | Ryu | G09G 3/3233 345/214 |
| 2014/0267215 | A1* | 9/2014 | Soni | G09G 3/3233 345/212 |
| 2014/0375623 | A1* | 12/2014 | Jaffari | G06F 17/5018 345/212 |

FOREIGN PATENT DOCUMENTS

| | | |
|---|---|---|
| KR | 10-0903476 | 6/2009 |
| KR | 10-2011-0047359 | 5/2011 |

* cited by examiner

ORGANIC LIGHT EMITTING DISPLAY AND DRIVING METHOD OF OPERATING THE SAME

CROSS-REFERENCE TO RELATED APPLICATION

This application claims priority from and the benefit of Korean Patent Application No. 10-2014-0125131 filed on Sep. 19, 2014, which is hereby incorporated by reference for all purposes as if fully set forth herein.

BACKGROUND

Field

Exemplary embodiments of the present invention relate to an organic light emitting display and a method of operating the same.

Discussion of the Background

Flat panel devices that may be reduced in size and weight have been recently developed. Examples of the flat panel devices may include a liquid crystal display, a field emission display, a plasma display panel, and an organic light emitting display. The organic light emitting display may display an image by using an organic light emitting device that generates light by recombining electrons and holes therein. The organic light emitting display may have a high response speed and operate with low power consumption.

However, the temperature of the organic light emitting display may rise as the operation time of the organic light emitting device increases, and such a rise in temperature may change electrical characteristics of the organic light emitting device within each pixel. Hence, the image quality and brightness of the organic light emitting display may deteriorate as the temperature changes.

To resolve such problems, a method of arranging a temperature sensor in a certain area of the organic light emitting display and compensating a data voltage applied to the organic light emitting device according to the measured temperature has been suggested. However, such a temperature compensation method may not measure the temperature of each pixel directly, but measure the temperature of each pixel indirectly through heat conduction. Accordingly, measured temperature information may contain errors and may not obtain precise temperature information.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments of the present invention provide an organic light emitting display that obtains temperature information by directly measuring the temperature of each pixel therein.

Exemplary embodiments of the present invention also provide a method of operating an organic light emitting display that obtains temperature information by directly measuring the temperature of each pixel therein.

Additional features of the inventive concept will be set forth in the description which follows, and in part will be apparent from the description, or may be learned by practice of the inventive concept.

According to an exemplary embodiment of the present invention, an organic light emitting display, includes a first data line extending along a first direction, a second data line extending along the first direction and disposed parallel to the first data line, a first scan line extending along a second direction perpendicular to the first direction, a first pixel connected to the first data line and the first scan line, a second pixel connected to the second data line and the first scan line, a first constant current source connected to the first data line and configured to generate a first driving current in a driving transistor of the first pixel, a second constant current source connected to the second data line and configured to generate a second driving current in a driving transistor of the second pixel, the second driving current being different than the first driving current, a temperature information generation unit comprising a first input port connected to the first data line and a second input port connected to the second data line.

The organic light emitting display may further include a first gate line extending along the second direction and connected to the first pixel and the second pixel.

The first pixel may include a control transistor configured to be turned on by a scan signal provided by the first scan line, a sensing transistor configured to be turned on by a gate signal provided simultaneously with the scan signal through the first gate line, an organic light emitting device configured to emit light in response to receiving the driving current from the driving transistor connected to one end of the organic light emitting device, and a switch configured to block connection between the one end of the organic light emitting device and the driving transistor.

The temperature information generation unit may be configured to calculate a voltage difference between a first voltage applied through the first input port and a second voltage applied through the second input port, and convert the calculated voltage difference into a digital value.

The first voltage may be a gate voltage of the driving transistor of the first pixel, and the second voltage may be a gate voltage of the driving transistor of the second pixel.

The first driving current and the second driving current may be a driving current corresponding to a sub-threshold region of the driving transistor, the sub-threshold region being a voltage range in which the driving current has an exponential relationship with a temperature of the driving transistor.

The temperature information generation unit may be configured to generate a first temperature information by using the first driving current and the second driving current, a second temperature information by using a third driving current and a fourth driving current, the third driving current is obtained by doubling the size of the first driving current, the fourth driving current is obtained by doubling the size of the second driving current, and a final temperature information by using the first temperature information and the second temperature information.

The temperature information generation unit may generate the final temperature information by deducting the second temperature information from the third temperature information.

According to an exemplary embodiment of the present invention, an organic light emitting display may include a display panel comprising pixels disposed in a matrix, scan lines extending in a horizontal direction, and data lines extending in a vertical direction, a temperature sensing unit including a first constant current source connected to an $a^{th}$ data line, a second constant current source connected to a $b^{th}$ data line, a temperature information generation unit configured to calculate a voltage difference between a first voltage generated in the $a^{th}$ data line by the first constant current source and a second voltage generated in the $b^{th}$ line by the second constant current source, in which wherein a is an odd-numbered constant and b is an even-numbered constant.

The temperature information generation unit may include a first input port to which the first voltage is applied and a second input port to which the second voltage is applied, and may be configured to convert the calculated voltage difference into a digital value.

The first voltage and the second voltage may be a gate voltage corresponding to a sub-threshold region of the driving transistor.

The organic light emitting display may further include gate lines extending along the horizontal direction and are connected to the pixels.

Pixels may include a control transistor configured to be turned on by a scan signal provided through the scan lines, a sensing transistor configured to be turned on by a gate signal provided simultaneously with the scan signal through the gate lines, an organic light emitting device configured to emit light in response to receiving the driving current from the driving transistor connected to one end of the organic light emitting device, and a switch configured to block connection between the one end of the organic light emitting device and the driving transistor.

The temperature information generation unit may include a first multiplexer unit to which the first voltage is applied, a second multiplexer to which the second voltage is applied, and a differential analog-digital converter configured to calculate a voltage difference between the first voltage and the second voltage, the second voltage is a voltage measured from a data line disposed in parallel with respect to a data line measuring the first voltage.

According to an exemplary embodiment of the present invention, a method of driving an organic light emitting display which includes pixels arranged in a matrix form, scan lines and gate lines extending in a horizontal direction, and data lines extending in a vertical direction, the method may include activating a temperature sensing mode of the pixels, providing scan signals and gate signals simultaneously to the scan lines and the gate lines, supplying a first constant current to an $a^{th}$ data line and a second constant current different in size from the first constant current to a $b^{th}$ data line, calculating a voltage difference between a first voltage generated in the $a^{th}$ data line by the first constant current source and a second voltage generated in the $b^{th}$ data line by the second constant current source, and calculating a temperature information, in which wherein a is an odd-numbered constant and b is an even-numbered constant.

Activating the temperature sensing mode may include connecting the first constant current source supplying the first constant current to the $a^{th}$ data line, connecting the second constant current source supplying the second constant current to the $b^{th}$ data line, and blocking connection between an organic light emitting device and a driving transistor of the pixels.

A driving transistor of a pixel connected to the $a^{th}$ data line may generate the first driving current from the first constant current, the driving transistor of the pixel connected to the $b^{th}$ data line may generate the second driving current from the second constant current, the second driving current having different size with respect to the first driving current, and the first driving current and the second driving current may be a driving current corresponding to a sub-threshold region of the driving transistor.

Calculating of the temperature information may include generating a first temperature information by using the first driving current and the second driving current, generating a second temperature information by using a third driving current and a fourth driving current, the third driving current is obtained by doubling the size of the first driving current, and the fourth driving current is obtained by doubling the size of the second driving current, and generating a final temperature information by using the first temperature information and the second temperature information.

The final temperature information may be generated by deducting the second temperature information from the third temperature information.

Calculating of the temperature information may include converting the voltage difference between the first voltage and the second voltage in to a digital value.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
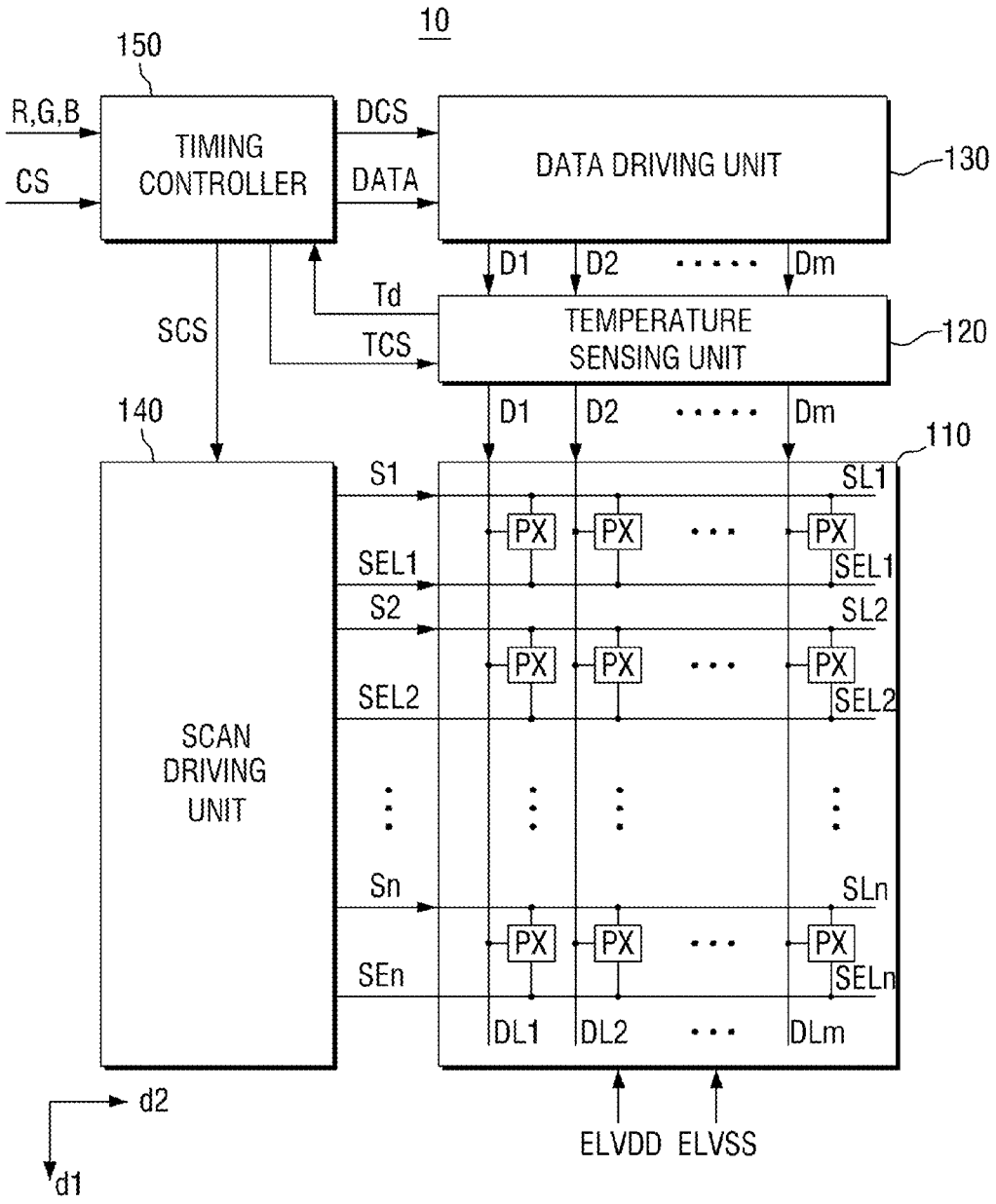
FIG. 1 is a block diagram of an organic light emitting display according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

FIG. 1 is a block diagram of an organic light emitting display according to an exemplary embodiment of the present invention.

Referring to FIG. 1, an organic light emitting display 10 includes a display panel 110, a temperature sensing unit 120, a data driving unit 130, a scan driving unit 140, and a timing controller 150.

The display panel 110 may display an image. The display panel 110 may include scan lines (SL1, SL2, . . . , SLn), data lines (DL1, DL2, . . . , DLm) intersecting the scan lines (SL1, SL2, . . . , SLn), and pixels PX respectively connected to one of the scan lines (SL1, SL2, . . . , SLn) and one of the data lines (DL1, DL2, . . . , DLm). Each of the data lines may intersect the scan lines, respectively. The data lines may extend along a first direction d1, and the scan lines may extend along a second direction d2 substantially perpendicular to the first direction d1. The first direction d1 may be a row direction and the second direction d2 may be a line direction. The scan lines may include first to $n^{th}$ scan lines (n is a natural number) disposed sequentially along the first direction d1. The data lines may include first to $m^{th}$ data lines (m is a natural number) disposed sequentially along the second direction d2.

The pixels may be arranged in a matrix form. Each of the pixels may be connected to one of the scan lines and one of the data lines. Each of the pixels may receive data voltages (D1, D2, . . . , Dm) applied to the connected data lines (DL1, DL2, . . . , DLm) which correspond to the scan signals (S1, S2, . . . , Sn) provided from the connected scan lines (SL1, SL2, . . . , SLn). That is, the scan lines (SL1, SL2, . . . , SLn) may receive scan signals (S1, S2, . . . , Sn) applied to respective pixels, and the data lines (DL1, DL2, . . . , DLm) may receive data voltages (D1, D2, . . . , Dm). Each pixel may be supplied with a first power voltage ELVDD through a first power line (not shown) and a second power voltage ELVSS through a second power line (not shown).

The display panel 110 may include a gate lines (SEL1, SEL2, . . . , SELn) extending along the same direction as the scan lines. The gate lines (SEL1, SEL2, . . . , SELn) may include first to $n^{th}$ gate lines disposed sequentially along the first direction d1. The first scan line SL1 and the first gate line SEL1 may be connected to the same pixel line group, and the remaining scan lines and gate lines may respectively be connected to the same pixel line group. The scan lines and gate lines may provide signals that turn on transistors included in each of the pixels.

The data driving unit 130 may provide the data voltages (D1, D2, . . . , Dm) to the data lines (DL1, DL2, . . . , DLm) of the display panel 110. The data driving unit 130 may receive a data control signal DCS and a data signal DATA from the timing controller 150, and the data driving unit 130 may process the data signal DATA according to the data control signal DCS to convert the data signal into the data voltages (D1, D2, . . . Dm). The data voltages (D1, D2, . . . , Dm) may be supplied to the corresponding data lines (DL1, DL2, . . . , DLm) through the temperature sensing unit 120. Each line that supplies the data voltages (D1, D2, . . . , Dm) may be connected to the data lines (DL1, DL2, . . . , DLm) by de-multiplexers 122 of the temperature sensing unit 120. When a temperature sensing mode is activated, the de-multiplexers 122 may disconnect the connection between the data voltage lines and the data lines to prevent the data voltage from being applied to the data line.

The scan driving unit 140 may generate scan signals (S1, S2, . . . , Sn). The scan driving unit 140 may sequentially provide scan signals (S1, S2, . . . Sn) to the first to $n^{th}$ scan lines (SL1, SL2, . . . , SLn). When the temperature sensing mode is activated, the scan driving unit 140 may generate and sequentially provide the first to $n^{th}$ gate signals (SE1, SE2, . . . , Sen) to the first to $n^{th}$ gate lines (SEL1, SEL2, . . . , SELn).

The timing controller 150 may receive a control signal CS and image signals R, G, B from an external system. The control signal CS may be a vertical synchronization signal Vsync, a horizontal synchronization signal Hsync, a data enable signal DE, and a clock signal CLK. The timing controller 150 may generate a scan control signal (SCS) to control the scan driving unit 140 and a data control signal (DCS) to control the data driving unit 130 based on the control signal CS. The data control signal (DCS) may be a source start pulse (SSP), a source sampling clock (SSC), and a source output enable signal (SOE). The scan control signal (SCS) may be a gate start pulse (GSP) and a gate sampling clock (GSC).

The timing controller 150 may generate a temperature sensing control signal (TCS) to control the temperature sensing unit 120. The temperature sensing control signal (TCS) may be a signal that activates and deactivates the temperature sensing mode. The temperature sensing mode may be activated when the overall power of the organic light emitting display 10 is turned on or off. That is, the temperature sensing mode may be activated during the waiting time that occurs when the organic light emitting display 10 is powered on or off. The temperature sensing mode may also be activated periodically or by the user's setting during the operation of the organic light emitting display 10.

The timing controller 150 may convert the input image signals R, G, B into data signals DATA. The timing controller 150 may process the image signals R, G, B by reflecting the temperature information Td provided in the temperature sensing unit 120. That is, the data signals DATA may be a compensated image data according to the temperature information Td of the display panel 110. The organic light emitting display 10 according to the present exemplary embodiment may be driven by the data signals DATA that reflects the temperature information Td of the display panel 110, and thus improve image quality.

The temperature sensing unit 120 may operate when the temperature sensing mode is activated. The temperature sensing unit 120 may generate the temperature information Td by measuring the temperature of each pixel PX of the display panel 110. The temperature sensing unit 120 may provide the generated temperature information Td to the timing controller 150. The temperature sensing unit 120 may operate separately with the data driving unit 130, or the temperature sensing unit 120 may be integrated together in the driving IC to form the data driving unit 130.

Figure 2:
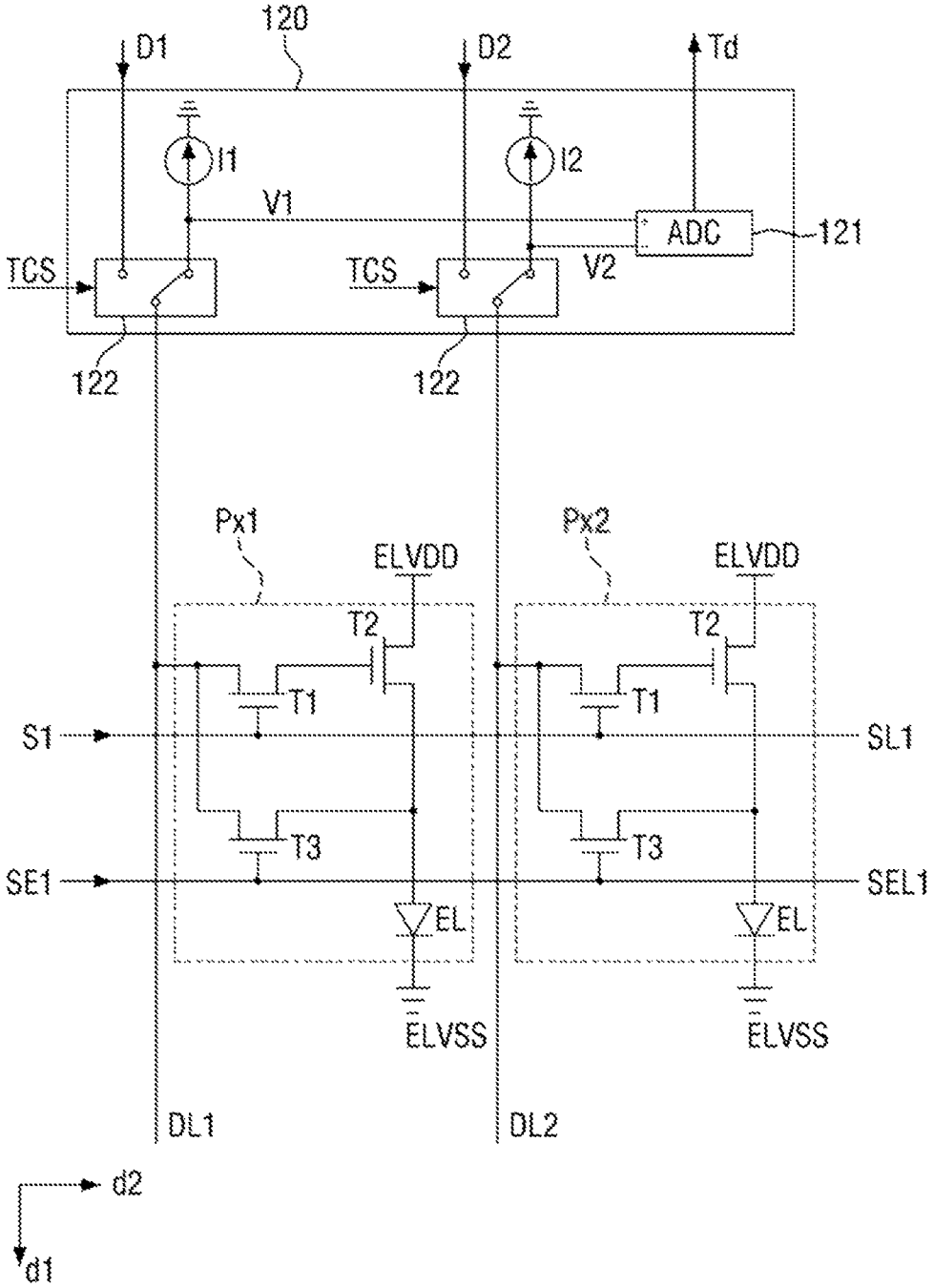
FIG. 2 is a circuit diagram schematically illustrating a configuration of a temperature sensing unit and each pixel connected to the temperature sensing unit according to an exemplary embodiment of the present invention.
Figure 3:
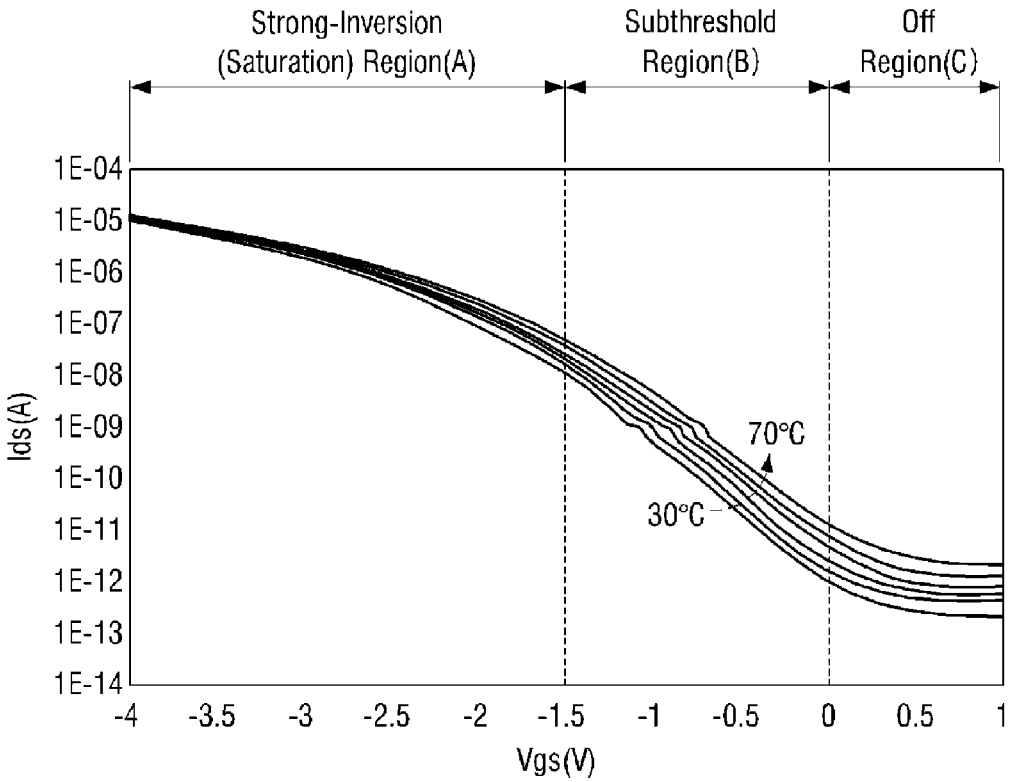
FIG. 3 is a graph illustrating the relationship between the temperature and a driving current according to the operation area of a driving transistor.
Figure 4:
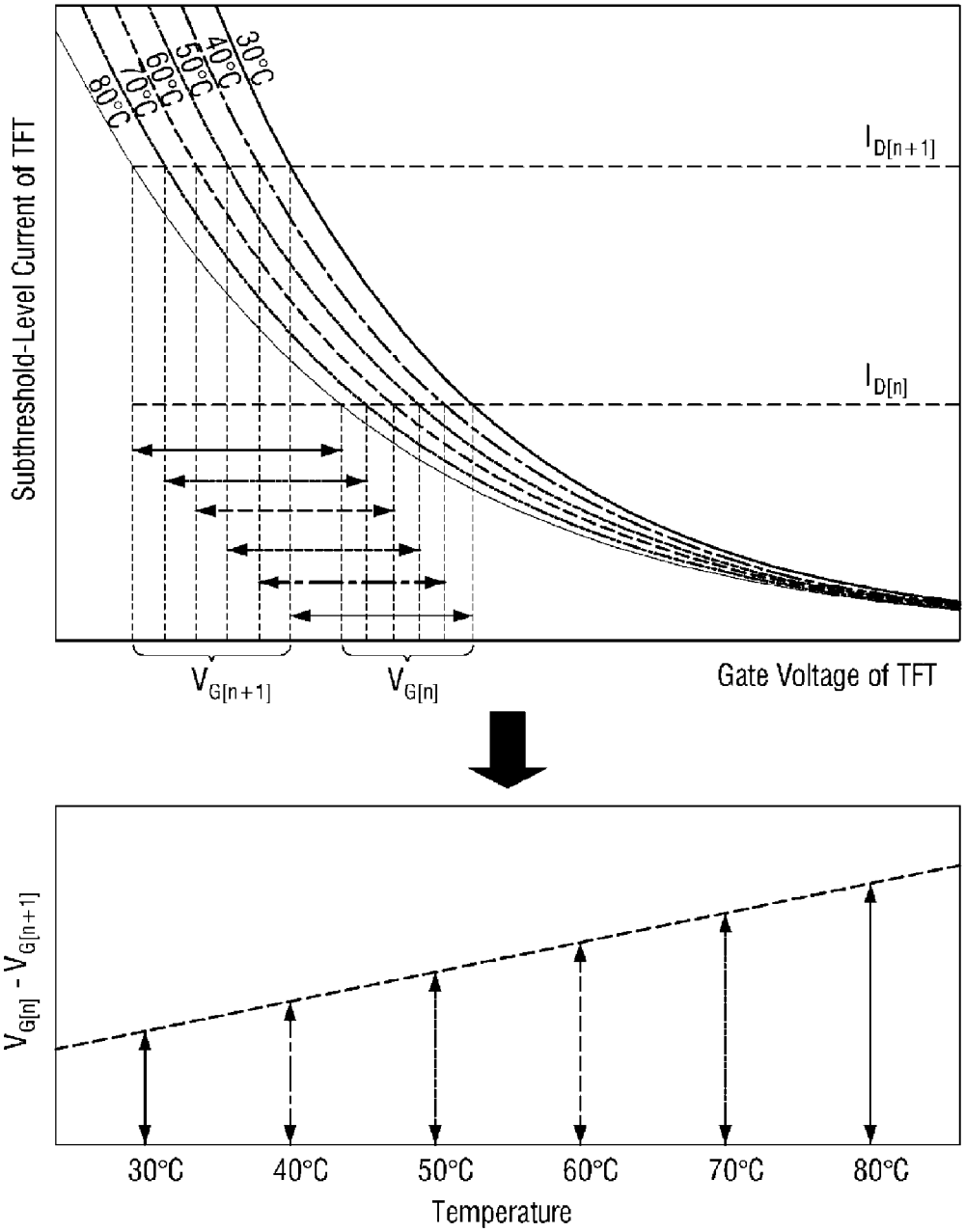
FIG. 4 is a graph illustrating the relationship between the measured voltage and the temperature.

FIG. 2 is a circuit diagram schematically illustrating a configuration of the temperature sensing unit 120 and each pixel PX connected to the temperature sensing unit 120 according to an exemplary embodiment of the present invention, FIG. 3 is a graph illustrating the relationship between the temperature and a driving current according to the operation area of a driving transistor, and FIG. 4 is a graph illustrating the relationship between the measured voltage and the temperature.

Referring to FIGS. 2 to 5, the temperature sensing unit 120 may include a first constant current source I1, a second constant current source I2, a temperature information generation unit 121, and de-multiplexers 122.

The first constant current source I1 may be connected to an $a^{th}$ data line (a is an odd-numbered constant) of the data lines (DL1, DL2, . . . , DLm). The second constant current source I2 may be connected to $b^{th}$ data line (b is an even-numbered constant) of the data lines (DL1, DL2, . . . , DLm). As illustrated in FIG. 2, the first constant current source I1 may be connected to the first data line DL1, and the second constant current source I2 may be connected to the second data line DL2. The first data line DL1 and the second data line DL2, which are adjacent to each other, may be respectively connected to the first constant current source I1 and the second constant current source I2 that induce currents of different sizes.

The first constant current source I1 and the second constant current source I2 may be respectively connected to the data lines (DL1, DL2, . . . , DLm) through the de-multiplexers 122. The organic light emitting display 10 according to the present exemplary embodiment may measure the voltage of each pixel and provide the data voltage to the temperature sensing unit 120 through data lines (DL1, DL2, . . . , DLm) formed on the display panel 110. When the organic light emitting display 10 operates, the de-multiplexers 122 may be connected to the lines that output the data voltages (D1, D2, . . . , Dm). However, when the temperature sensing mode is activated, the de-multiplexers 122 may be connected to the corresponding constant current sources I1 and I2 respectively, rather than the lines that output the data voltages (D1, D2, . . . , Dm), in order to block the inflow of the data voltages (D1, D2, . . . , Dm).

The temperature information generation unit 121 may be connected to the first data line DL1 and the second data line DL2. The first input port (+) of the temperature information generation unit 121 may be connected to the first data line DL1, and the second input port (−) may be connected to the second data line DL2. When multiple temperature information generation units 121 are provided, each temperature information generation unit 121 may be respectively connected to an $a^{th}$ data line (a is an odd-numbered constant) and $b^{th}$ data line (b is an even-numbered constant). The temperature information generation unit 121 may compare the first voltage applied in the $a^{th}$ data line by the first constant current source I1 with the second voltage applied in the $b^{th}$ data line by the second constant current source I2 to calculate the voltage difference. That is, the temperature information generation 121 may be a differential amplifier. The temperature information generation unit 121 may convert the voltage difference into a digital value to generate the temperature information Td of each pixel. That is, the temperature information generation unit 121 may be a differential analog-digital converter (fully differential ADC). The voltage difference between the first voltage and the second voltage may be proportional to the temperature of the pixel, and the generated temperature information Td may have a linear relationship with the temperature of the pixel. The temperature information generation unit 121 may provide the temperature information Td of the pixel to the timing controller 150. Hereinafter, a method of generating the temperature information Td of the pixel PX to which the temperature sensing unit 120 is connected will be described in detail.

Pixels PX may include a first pixel PX1 and a second pixel PX2. The first pixel PX1 may be connected to the first data line DL1 and the first scan line SL1, and the second pixel PX2 may be connected to the second data line DL2 and the second scan line SL2. The first pixel PX1 and the second pixel PX2 may also be connected to the first gate line SEL1. The operation of the first pixel PX1 and the second pixel PX2 may be substantially similar for the pixels respectively connected to the $a^{th}$ data line and the $b^{th}$ data line among group of pixels PX arranged along the same scan line.

The first pixel PX1 may include a first transistor T1, a second transistor T2, a third transistor T3, and an organic light emitting device EL. A gate port of the first transistor T1 may be connected to the first scan line SL1, the source port of the first transistor T1 may be connected to the first data line DL1, and the drain port of the first transistor T1 may be connected to a gate port of the second transistor T2. The first transistor T1 may be a control transistor that supplies a data voltage to the gate port of the second transistor T2, in which the data voltage is turned on by the scan signal S1 applied through the first scan line and supplied to the first transistor T1 by the data line DL1. The gate port of the second transistor T2 may be connected to the drain port of the first transistor T1, the source port of the second transistor T2 may be connected to the first power voltage ELVDD, and the drain port of the second transistor T2 may be connected to the organic light emitting device EL. In the second transistor T2, the current Ids which corresponds to the relation between the data voltage applied to the gate port and the voltage of the source-drain port may be formed in the channel. The current Ids may be a driving current which drives the organic light emitting device EL to emit light, and the second transistor T2 may be a driving transistor.

In the organic light emitting device EL, an anode port may be connected to the drain port of the second transistor T2, and a cathode port may be connected to the second power voltage ELVSS. The organic light emitting device EL may emit light having a brightness that corresponds to the driving current. The gate port of the third transistor T3 may be connected to the first gate line SEL1, the source port of the third transistor T3 may be connected to the first data line DL1, and the drain port of the third transistor T3 may be connected to the organic light emitting device EL. That is, the drain port of the third transistor T3 may be connected to the drain port of the second transistor T2. Since the gate signal SE1 is provided when the temperature sensing mode is activated, the third transistor T3 may not operate when the temperature sensing mode is deactivated. That is, the third transistor T3 may be a sensing transistor.

The second pixel PX2 may also include a first transistor T1, a second transistor T2, a third transistor T3, and an organic light emitting device EL. The second pixel PX2 is connected to the second data line DL2 which is connected to the source port of the first transistor T1 and the third transistor T3. The structure of the second pixel PX2 may be substantially similar to the first pixel PX1, and thus repeated description of the substantially similar elements and operations illustrated with respect to the first pixel PX1 will be omitted.

When the temperature sensing mode is activated (i.e., when the first data line DL1 and the first constant current source I1 are connected), the first scan signal S1 and the first gate signal SE1 may be simultaneously provided to the first scan line SL1 and the first gate line SEL1. Accordingly, the first pixel PX1, the first transistor T1, and the third transistor T3 may be simultaneously turned on. As such, in the second transistor T2, the gate port and the drain port may be diode-connected. The first driving current may be generated in the channel of the second transistor T2 of the first pixel PX1 by the first constant current source I1 supplied through the first data line DL1.

The second pixel PX2 that neighbors the first pixel PX1 in the second direction d2 may operate substantially similar to the first pixel PX1 described above. The second pixel PX2, the first transistor T1, and the third transistor T3 may be simultaneously turned on, and the gate port and the drain port of the second transistor T2 may be diode-connected. The second driving current may be generated in the channel of the second transistor T2 of the second pixel PX2 by the second constant current source I2 supplied through the second data line DL2.

The first constant current source I1 and the second constant current source I2 may supply current of different sizes. The sizes of the first driving current Ids1 and the second driving current Ids2 generated by the first constant current source I1 and the second constant current source I2, respectively, may be different from each other. The first driving current Ids1 and the second driving current Ids2 may be a driving current generated when the second transistor T2 operates in the sub-threshold region.

The sub-threshold region may correspond to the voltage level between the threshold voltage Vth and the off voltage of the gate-source voltage Vgs. Referring to FIG. 3, the sub-threshold region is indicated as Subthreshold Region (B). The second transistors T2 of the first pixel PX1 and the second pixel PX2 may operate in the sub-threshold region by the first constant current course I1 and the second constant current source I2. In the sub-threshold region, the driving current Ids may increase as the temperature rises. That is, in the sub-threshold region, the temperature and the driving current Ids may have an exponential relationship as shown in Equation 1, to which an Arrhenius-like model has been applied.

$$I_{DS} = \alpha \cdot e^{\frac{|V_{GS}|-|V_{TH}|}{\beta \cdot T}} \quad \text{[Equation 1]}$$

α and β are constant values, $I_{DS}$ is a driving current, T is an absolute temperature of a driving transistor, $V_{GS}$ is a gate-source voltage of the driving transistor, and the $V_{TH}$ is a threshold voltage of the driving transistor.

The voltage of the source port of the second transistor T2 (driving transistor) may be the first power voltage ELVDD, and thus the voltage of the gate port $V_G$ of the second transistor T2 (driving transistor) may be defined as shown in Equation 2 below.

$$V_G = ELVDD - V_{TH} - \beta T \ln\left(\frac{I_{DS}}{\alpha}\right) \quad \text{[Equation 2]}$$

The difference between the voltages of different gate ports corresponding to the sub-threshold region may be defined as the Equation 3 below.

$$V_{G[n]} - V_{G[n+1]} = \left[ELVDD - |V_{TH}| - \beta \cdot T \cdot \ln\left(\frac{I_{D[n]}}{\alpha}\right)\right] - \left[ELVDD - |V_{TH}| - \beta \cdot T \cdot \ln\left(\frac{I_{D[n+1]}}{\alpha}\right)\right] = T \cdot \beta \ln\left(\frac{I_{D[n+1]}}{I_{D[n]}}\right) \quad \text{[Equation 3]}$$

$I_{D[n]}$ and $I_{D[n+1]}$ may be the driving voltage of the driving transistor corresponding to the gate voltage ($V_{G[n]}$, $V_{G[n+1]}$) of each driving transistor, and $\ln(I_{D[n]}/I_{D[n-1]})$ may be calculated as a constant value. That is, the voltage difference between different gate ports ($V_{G[n]}-V_{G[n+1]}$) corresponding to the sub-threshold region may be linearly proportional to the temperature T of the driving transistor. Referring to FIG. 4, the voltage difference between the different gate ports ($V_{G[n]}-V_{G[n+1]}$) corresponding to the sub-threshold region increases as the temperature T of the driving transistor T2 rises.

The temperature sensing unit 120 according to an exemplary embodiment of the present invention may calculate the temperature of the first pixel PX1 and the second pixel PX2 directly by using the characteristics of the driving transistor T2 illustrated with reference to FIGS. 3 and 4. The first pixel PX1 and the second pixel PX2 are adjacent to each other, and thus the first pixels PX1 and the second pixels PX2 may have substantially similar temperatures. Accordingly, the driving transistor T2 of the first pixel PX1 may generate the first driving current Ids1 that operates in the sub-threshold region by the current supplied from the first constant current source I1, and the driving transistor T2 of the second pixel PX2 may generate the second driving current Ids2 that operates in the sub-threshold region by the current supplied in the second constant current source I2. The temperature information generation unit 121 of the temperature sensing unit 120 may measure the first voltage V1 of the first data line DL1 generated by the first constant current source I1, and the second voltage V2 of the second data line DL2 generated by the second constant current source I2. The first input port (+) of the temperature information generation unit 121 may be connected to the first data line DL1, and the second input port (−) of the temperature information generation unit 121 may be connected to the second data line DL2. The first voltage V1 may be a voltage of the gate port of the driving transistor T2 of the first pixel PX1, and the second voltage V2 may be the voltage of the gate port of the driving transistor T2 of the second pixel PX2.

The temperature information generation unit 121 may generate temperature information Td by calculating the difference between the first voltage V1 and the second voltage V2, and then converting the difference into a digital value. The temperature information generation unit 121 may provide the generated temperature information Td to the timing controller 150. As the temperature information Td have linear relationship of the temperatures of the current first pixel PX1 and second pixel PX2, the timing controller 150 may compensate the data voltage supplied to the first pixel PX1 and the second pixel PX2 by reflecting the temperature information Td without an additional lookup table LUT.

According to an exemplary embodiment of the present invention, the organic light emitting display 10 may provide the temperature of each pixel and linear temperature information by directly calculating the temperature of each pixel, and thus more accurate temperature information Td may be provided. Further, the compensating the data voltage based on the temperature information Td may improve display quality.

Hereinafter, an organic light emitting display according to an exemplary embodiment of the present invention will be described.

Figure 5:
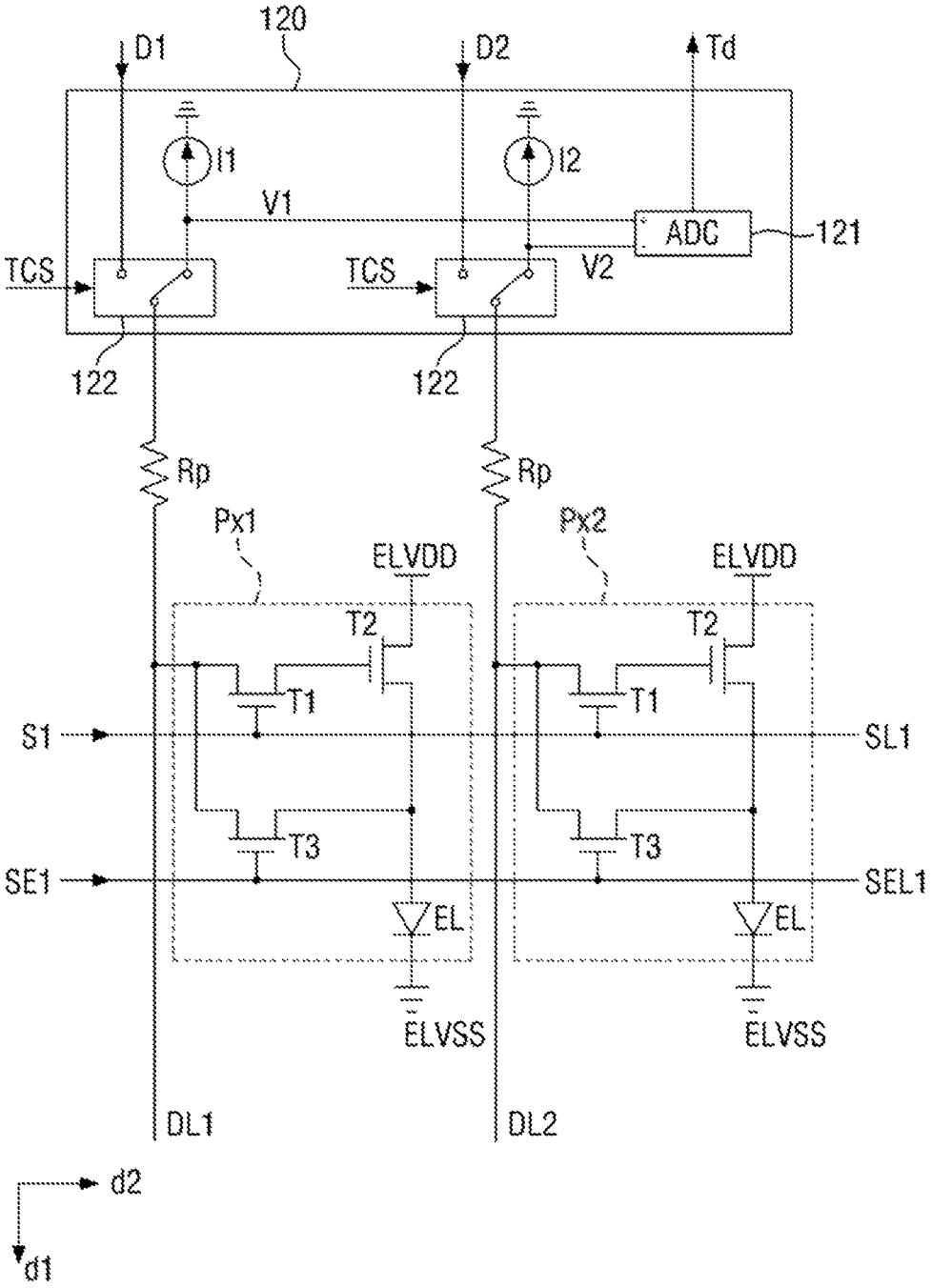
FIG. 5 is a circuit diagram schematically illustrating a configuration of a temperature sensing unit and each pixel connected to the temperature sensing unit according to an exemplary embodiment of the present invention.

FIG. 5 is a circuit diagram schematically illustrating the configuration of a temperature sensing unit 120 and each pixel connected to the temperature sensing unit 120 according to an exemplary embodiment of the present invention. The temperature sensing unit 120 of the present exemplary embodiment have substantially similar elements with the temperature sensing unit 120 illustrated with reference to FIGS. 1 to 4. Accordingly, repeated description of the substantially similar elements and operations illustrated with reference to FIGS. 1 to 4 will be omitted.

Referring to FIG. 5, a voltage drop ($I_{DS}$·Rp) may occur by the parasitic resistance of the first data line DL1 and the second data line DL2 in the first voltage V1 and the second voltage V2, which are measured by the temperature information generation unit 121. Accordingly, the temperature information Dout calculated in the temperature information generation unit 121 may contain an error as shown in Equation 4.

$$V_G = ELVDD - V_{th} - \beta T \ln\left(\frac{I_{DS}}{\alpha}\right) - I_{DS} \cdot R_P \qquad \text{[Equation 4]}$$

$$D_{OUT}(I_{D[n]}, I_{D[n+1]}) = T \cdot \beta \ln\left(\frac{I_{D[n+1]}}{I_{D[n]}}\right) + R_P \cdot (I_{D[n+1]} - I_{D[n]})$$

The temperature information generation unit 121 according to the present exemplary embodiment may generate a first temperature information by using the first driving current and the second driving current, and generate a second temperature information by using a third driving current obtained by doubling the size of the first driving current and a fourth driving obtained by doubling the size of the second driving current. That is, the first constant current source I1 may supply the size-increased constant current to the driving transistor T2 to generate the third driving current, and the second constant current source I2 may supply the size-increased constant current to the driving transistor T2 to generate the fourth driving current. The third driving current and the fourth driving current may be the driving current corresponding to the sub-threshold region of the driving transistor T2. The temperature information generation unit 121 may generate a final temperature information Td by using the first temperature information and the second temperature information and removing the error from the parasitic resistance Rp. The final temperature information Td may be obtained by increasing the first temperature information by twice to obtain the third temperature information and then deducting the second temperature information from the third temperature information. The final temperature information Td may be defined as shown in Equation 5 below.

$$2 \cdot D_{OUT}(I_{D[n]}, I_{D[n+1]}) - D_{OUT}(2I_{D[n]}, 2I_{D[n+1]}) = T \cdot \beta \ln\left(\frac{I_{D[n+1]}}{I_{D[n]}}\right) \qquad \text{[Equation 5]}$$

The organic light emitting display device according to an exemplary embodiment of the present invention may calculate the final temperature information Td according to Equation 5 which remove the voltage drop factor caused by the parasitic resistance.

Figure 6:
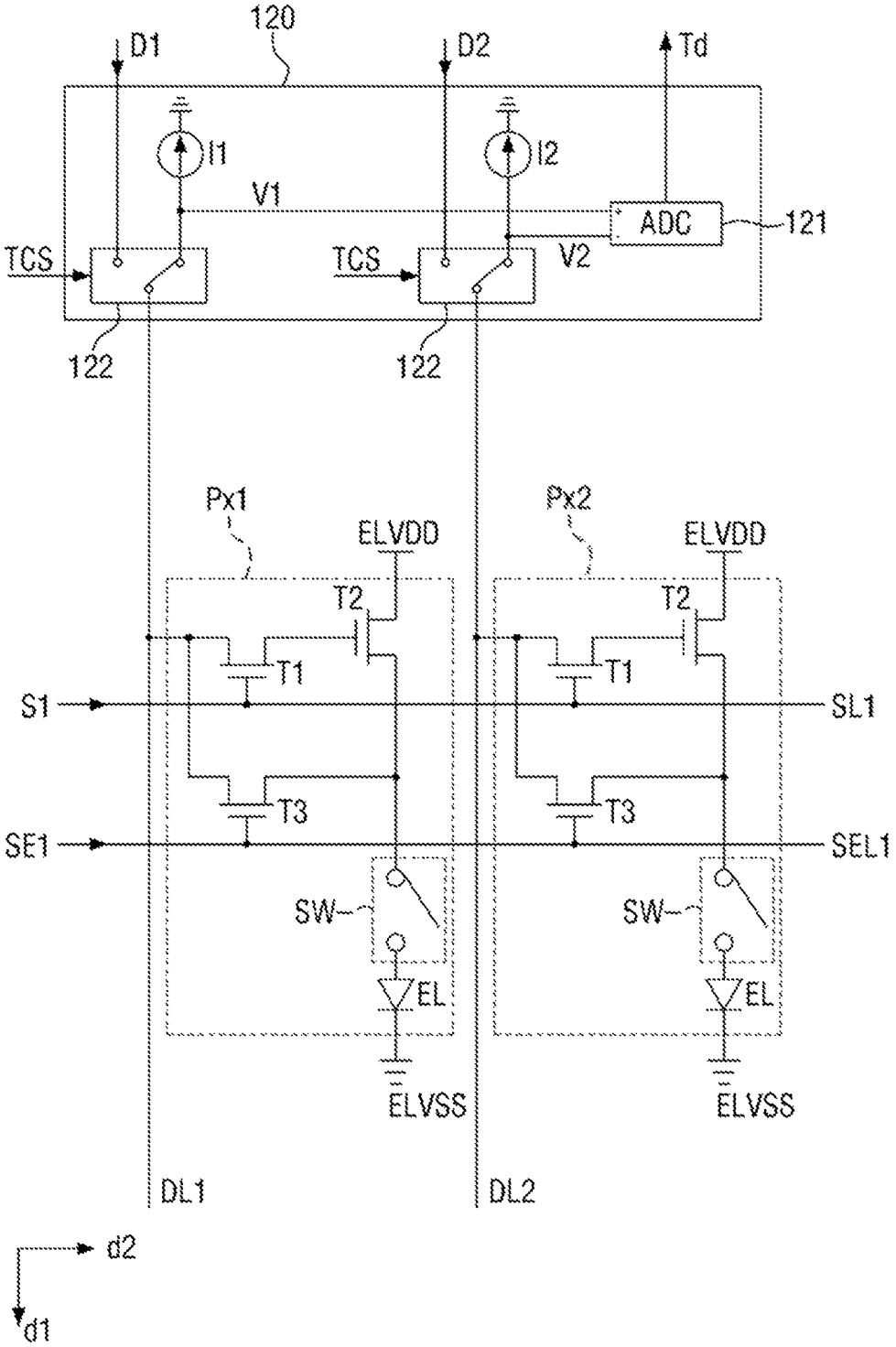
FIG. 6 is a circuit diagram schematically illustrating a configuration of a temperature sensing unit and each pixel connected to the temperature sensing unit according to an exemplary embodiment of the present invention.

FIG. 6 is a circuit diagram schematically illustrating the configuration of a temperature sensing unit 120 and each pixels connected to the temperature sensing unit 120 according to an exemplary embodiment of the present invention. The temperature sensing unit 120 of the present exemplary embodiment have substantially similar elements with the temperature sensing unit 120 illustrated with reference to FIGS. 1 to 4. Accordingly, repeated description of the substantially similar elements and operations illustrated with reference to FIGS. 1 to 4 will be omitted.

Referring to FIG. 6, the organic light emitting display according to the present embodiment may include a switch SW arranged between the driving transistor T2 and the anode port of the organic light emitting device EL.

The switch SW may be controlled by the timing controller 150. When the temperature sensing mode is activated, the switch SW may block the connection between the driving transistor T2 and the anode port of the organic light emitting display EL. Accordingly, the inflow of the driving current of the driving transistor T2 into the organic light emitting display EL may be completely blocked in the temperature sensing mode. Hence, the organic light emitting display according to the present embodiment may accurately measure the temperature information.

Figure 7:
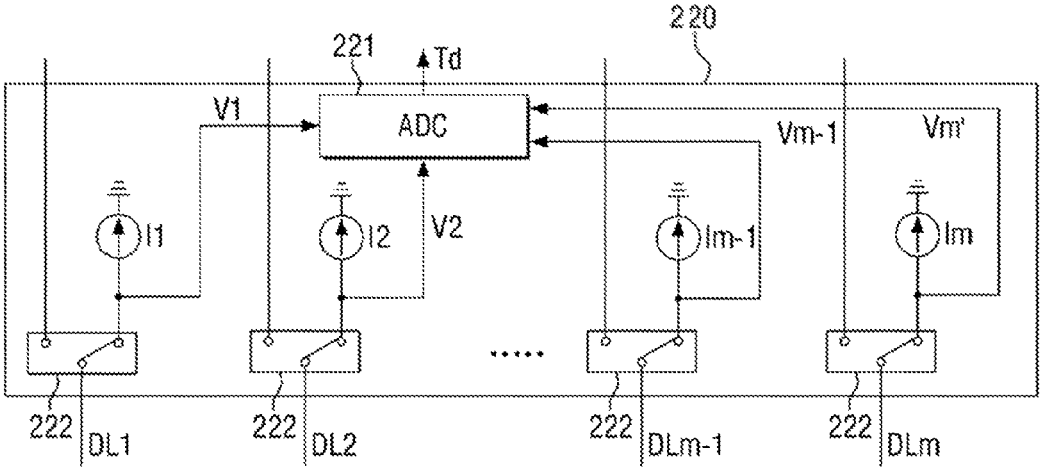
FIG. 7 is a circuit diagram of a temperature sensing unit according to an exemplary embodiment of the present invention.
Figure 8:
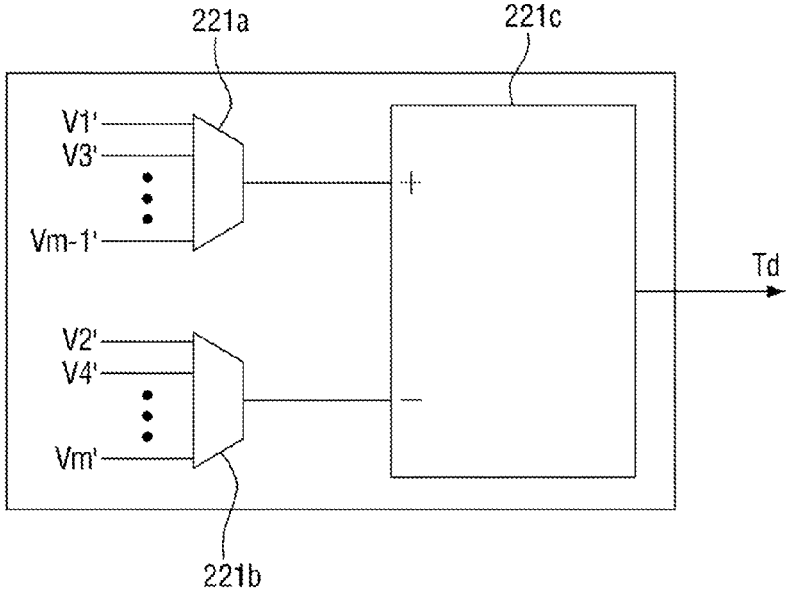
FIG. 8 is a block diagram of a temperature information generation unit according to an exemplary embodiment of the present invention.

FIG. 7 is a block diagram of a temperature sensing unit 220 according to an exemplary embodiment of the present invention, and FIG. 8 is a circuit diagram of a temperature information generation unit 221.

Referring to FIGS. 7 and 8, the temperature sensing unit 220 according to the present exemplary embodiment may include a temperature information generation unit 221 and de-multiplexers 222. The de-multiplexers 222 may be respectively correspond and connected to data lines (DL1, DL2, . . . , DLm). Accordingly, a constant current may be supplied to each data lines through the de-multiplexers 222, and the voltage of each data line may be measured. The measured voltage of each data lines may be supplied to the temperature information generation unit 221. The temperature sensing unit 220 may include a single temperature information generation unit 221. Accordingly, voltages measured in the data lines may be provided to the temperature information generation unit 221. The temperature information generation unit 221 may include a first multiplexer unit 221*a* and a second multiplexer unit 221*b*. The voltages (V1, V3, . . . , Vm−1) measured in the $a^{th}$ data lines (DL1, DL3, . . . , DLm−1, a is an odd constant) may be supplied to the first multiplexer unit 221*a*, and the voltages (V2, V4, . . . Vm) measured in the $b^{th}$ data lines (DL2, DL4, . . . , DLm, b is an even constant) may be supplied to the second multiplexer unit 221*b*. The voltages measured in the first multiplexer 221*a* and the second multiplexer 221*b* may be sampled and supplied together. The first multiplexer 221*a* and the second multiplexer 221*b* may supply a single voltage to a differential analog-digital converter (ADC) 221*c* according to the control signal. The first voltage output from the first multiplexer 221*a* may be a voltage measured from the data lines neighboring the second multiplexer 221*b* outputting the second voltage in the horizontal direction. The first multiplexer 221*a* and the second multiplexer 221*b* may selectively output a pair of voltages measured from the neighboring data lines to the differential analog-digital converter (ADC) 221*c*.

The differential analog-digital converter (ADC) 221*c* may calculate the voltage difference of the pair of voltages to generate temperature information. The organic light emitting display according to the present exemplary embodiment may not require the differential ADC for every neighboring data line pair, and generate the temperature information by calculating the voltage difference of respective data line pairs with a single differential analog-digital converter (ADC) 221*c* in a time-interleaving scheme by using the first and the second multiplexers 221*a* and 221*b*. Accordingly, the manufacturing costs for having differential analog-digital converter (ADC) may be reduced.

Figure 9:
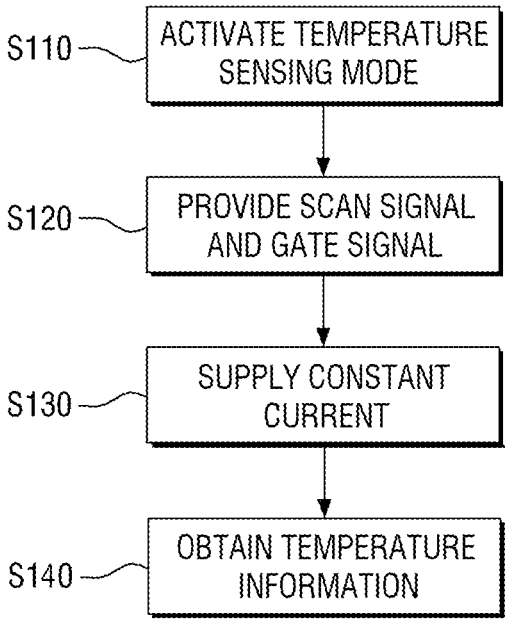
FIG. 9 is a flowchart illustrating a method of driving an organic light emitting display according to an exemplary embodiment of the present invention.

FIG. 9 is a flowchart illustrating a method of driving an organic light emitting display according to an exemplary embodiment of the present invention.

Referring to FIG. 9, the method of operating the organic light emitting display according to an exemplary embodiment of the present invention may include activating temperature sensing mode of the pixels (S110), providing scan signals and gate signals (S120), supplying constant current (S130), and obtaining temperature information (S110).

In step S110, a temperature sensing mode is activated.

The organic light emitting display according to the present exemplary embodiment may include pixels arranged in a matrix form, scan lines extending in a horizontal direction, gate lines extending in a horizontal direction, and data lines extending in a vertical direction. The data lines may be divided into $a^{th}$ data lines (a is an odd constant) and $b^{th}$ data lines (b is an even constant). The organic light emitting display illustrated with respect to FIGS. 1 to 8 may be applied, and thus the detailed description thereof will be omitted.

The timing controller 150 of the organic light emitting display may generate a temperature sensing control signal (TCS) to control the temperature sensing unit 120 for sensing temperatures of the pixels. The temperature sensing control signal (TCS) may be a signal that activates or deactivates the temperature sensing mode. The temperature sensing mode may be activated when the overall power of the organic light emitting display 10 is turned on or off. The temperature sensing mode may be activated during the waiting time of the power turning on or off. The temperature sensing mode may also be activated periodically or by the user's setting during the operation of the organic light emitting display 10. In response to the temperature sensing control signal (TCS), the $a^{th}$ data line (a is an odd constant) may be connected to the first constant current source I1 which supplies the first constant current, and the $b^{th}$ data line (b is an even constant) may be connected to the second constant current source I2. Further, the voltage of both ends of the organic light emitting device may be set to have substantially similar voltage level. That is, the voltage level of the second power voltage ELVSS connected to one end of the organic light emitting device may increase to correspond to the voltage level of the first power voltage ELVDD connected to the other end of the organic light emitting device. As such, the driving current flowing in the channel of the driving transistor T2 may not flow into the organic light emitting device.

According to an exemplary embodiment of the present invention, the organic light emitting device and the driving transistor may be connected by a switch which is turned off in the temperature sensing mode, and accordingly, the connection between the organic light emitting device and the driving transistor may be blocked when the temperature sensing mode is activated.

In step S120, the scan signals and gate signals are provided.

The scan signals may be provided through a scan line connected to the pixels, and the gate signals may be supplied through a gate line connected to the pixels. The scan signals and gate signals may be simultaneously provided. Each pixels may include an organic light emitting device, a control transistor which is turned on by a scan signal, a sensing transistor which is turned on by a gate signal, and a driving transistor that supplies the driving current to the organic light emitting device to emit light therein. The drain port of the control transistor may be connected to the gate port of the driving transistor, and the drain port of the sensing transistor may be connected to the drain port of the driving transistor. Accordingly, the driving transistor may be in a diode-connected state as the scan signals and the gate signals are simultaneously provided.

In step S130, constant current is supplied (S130).

First constant current may be supplied to the $a^{th}$ data line (a is an odd constant), and the second constant current having a different size from the first constant current may be supplied to the $b^{th}$ data line (b is an even constant). The first constant current may be a constant current that generates the first driving current in the driving transistor T2 of the pixel connected to the $a^{th}$ data line. The first driving current may be a driving current corresponding to the sub-threshold region of the driving transistor T2. The second constant current may be a constant current that generates the second driving current in the driving transistor T2 of the pixel connected to the $b^{th}$ data line. The second driving current may be a current having a different size from the first driving current and may be a driving current corresponding to the sub-threshold region of the driving transistor T2. The sub-threshold region may be an operation area of the driving transistor T2 where the driving current increases exponentially with a rise of the temperature. The difference between the gate voltage of the driving transistor T2 corresponding to the first driving current and the gate voltage of the driving transistor T2 corresponding to the second driving current may be calculated to be linearly proportional to the second driving current.

In step S130, the temperature information is calculated (S130).

The first voltage generated in the $a^{th}$ data line according to the application of the first constant current source I1, and the second voltage generated in the $b^{th}$ data line according to the application of the second current source I2 may be measured. The first voltage may be a gate voltage of the driving transistor T2 of the pixel connected to the $a^{th}$ data line, and the second voltage may be a gate voltage of the driving transistor T2 of the pixel connected to the $b^{th}$ data line. The difference between the first voltage and the second voltage may be linearly proportional to the current temperatures of the pixels arranged sequentially. The voltage difference between the first voltage and the second voltage may be modified as a digital value to calculate temperature information.

According to an exemplary embodiment of the present invention, calculating the temperature information may include generating a first temperature information by using the first driving current and the second driving current, generating the second temperature information by using a third driving current obtained by doubling the size of the first driving current and a fourth driving current obtained by doubling the size of the second driving current, and generating the final temperature information Td by using the first temperature information and the second temperature information. The final temperature information Td may be generated by increasing the first temperature information by twice to obtain the third temperature information and then deducting the second temperature information.

According to exemplary embodiments of the present invention, more accurate temperature information may be provided by directly measuring a temperature of each pixel of an organic light emitting display. Further, according to exemplary embodiments of the present invention, the display quality of an organic light emitting display may be enhanced because a data voltage is compensated in consideration of a temperature of each pixel which has been precisely measured.

Although certain exemplary embodiments and implementations have been described herein, other embodiments and modifications will be apparent from this description. Accordingly, the inventive concept is not limited to such exemplary embodiments, but rather to the broader scope of the presented claims and various obvious modifications and equivalent arrangements.

What is claimed is:

1. An organic light emitting display, comprising:

a first data line extending along a first direction;

a second data line extending along the first direction and disposed parallel to the first data line;

a first scan line extending along a second direction perpendicular to the first direction;

a first pixel connected to the first data line and the first scan line;

a second pixel connected to the second data line and the first scan line;

a first constant current source connected to the first data line and configured to generate a first driving current in a driving transistor of the first pixel;

a second constant current source connected to the second data line and configured to generate a second driving current in a driving transistor of the second pixel, the second driving current being different than the first driving current; and a temperature circuit comprising a first input port connected to the first data line and a second input port connected to the second data line, wherein the first driving current and the second driving current are driving currents corresponding to a sub-threshold region of the driving transistor, wherein the sub-threshold region being a voltage range in which the driving current has an exponential relationship with a temperature of the driving transistor, and wherein the temperature circuit is configured to generate:

a first temperature information by using the first driving current and the second driving current;

a second temperature information by using a third driving current and a fourth driving current, the third driving current is obtained by doubling the size of the first driving current, the fourth driving current is obtained by doubling the size of the second driving current; and a final temperature information by using the first temperature information and the second temperature information.

2. The organic light emitting display of claim 1, further comprising a first gate line extending along the second direction and connected to the first pixel and the second pixel.

3. The organic light emitting display of claim 2, wherein the first pixel comprises:

a control transistor configured to be turned on by a scan signal provided by the first scan line;

a sensing transistor configured to be turned on by a gate signal provided simultaneously with the scan signal through the first gate line;

an organic light emitting device configured to emit light in response to receiving the driving current from the driving transistor connected to a first end of the organic light emitting device; and a switch configured to block a connection between the first end of the organic light emitting device and the driving transistor.

4. The organic light emitting display of claim 1, wherein the temperature circuit is configured to:

calculate a voltage difference between a first voltage applied through the first input port and a second voltage applied through the second input port; and convert the calculated voltage difference into a digital value.

5. The organic light emitting display of claim 4, wherein:

the first voltage is a gate voltage of the driving transistor of the first pixel; and the second voltage is a gate voltage of the driving transistor of the second pixel.

6. The organic light emitting display of claim 1, wherein the temperature circuit generates the final temperature information by deducting the second temperature information from a third temperature information.

7. A method of driving an organic light emitting display comprising pixels arranged in a matrix form, scan lines and gate lines extending in a horizontal direction, and data lines extending in a vertical direction, the method comprising:

activating a temperature sensing mode of the pixels;

providing scan signals and gate signals simultaneously to the scan lines and the gate lines;

supplying a first constant current to an $a^{th}$ data line and a second constant current different in size from the first constant current to a $b^{th}$ data line;

calculating a voltage difference between a first voltage generated in the $a^{th}$ data line by the first constant current source and a second voltage generated in the $b^{th}$ data line by the second constant current source; and calculating a temperature information, wherein a is an odd-numbered constant and b is an even-numbered constant, and wherein calculating of the temperature information comprises:

generating a first temperature information by using the first driving current and the second driving current;

generating a second temperature information by using a third driving current and a fourth driving current, the third driving current being obtained by doubling the size of the first driving current, and the fourth driving current being obtained by doubling the size of the second driving current; and generating a final temperature information by using the first temperature information and the second temperature information, wherein a driving transistor of a pixel connected to the ath data line generates the first driving current from the first constant current;

the driving transistor of the pixel connected to the bth data line generates the second driving current from the second constant current, the second driving current having different size with respect to the first driving current; and the first driving current and the second driving current are driving currents corresponding to a sub-threshold region of the driving transistor, the sub-threshold region being a voltage range in which the driving current has an exponential relationship with a temperature of the driving transistor.

8. The method of claim 7, wherein the activating the temperature sensing mode comprises:

connecting the first constant current source supplying the first constant current to the $a^{th}$ data line;

connecting the second constant current source supplying the second constant current to the $b^{th}$ data line; and blocking a connection between an organic light emitting device and a driving transistor of the pixels.

9. The method of claim 7, wherein the final temperature information is generated by deducting the second temperature information from a third temperature information.

10. The method of claim 7, wherein calculating of the temperature information comprises converting the voltage difference between the first voltage and the second voltage in to a digital value.

* * * * *